United States Patent [19]

Van Leemput

[11] 4,000,235

[45] Dec. 28, 1976

[54] METHOD FOR MOLDING PARTICULATE MATERIAL INTO RODS

[75] Inventor: Hendrik Van Leemput, Duffel, Belgium

[73] Assignee: National Forge Company, Irvine, Pa.

[22] Filed: May 13, 1975

[21] Appl. No.: 577,064

[52] U.S. Cl. ..... 264/109; 264/111; 264/313

[51] Int. Cl.[2] ..... B22C 15/02

[58] Field of Search ..... 264/101, 109, 313, 111, 264/DIG. 50; 425/405 H, DIG. 44

[56] References Cited

UNITED STATES PATENTS

| | | | |
|---|---|---|---|
| 1,855,855 | 4/1932 | Gillis et al. | 425/78 |
| 2,298,908 | 10/1942 | Wentworth | 264/111 |
| 2,893,102 | 7/1959 | Maxwell et al. | 264/101 |
| 3,051,567 | 8/1962 | Ziegler | 106/44 |
| 3,086,248 | 4/1963 | Culp | 264/101 |

*Primary Examiner*—Jan H. Silbaugh
*Assistant Examiner*—James R. Hall
*Attorney, Agent, or Firm*—Alfred L. Michaelsen

[57] ABSTRACT

An improved method for isostatically molding an elongated, cylindrical article from a powdered material. In accordance with the improved method, a mold, containing powdered material, is placed within a two-piece, perforated canister. The two pieces which form the canister are then resiliently clamped together. Thereafter, in accordance with conventional practice, the canister and the mold containing the powdered material are subjected to an isostatic pressing process. During the decompression step of this process, the mold may radially expand by pressing outwardly against the two-piece canister and thereby causing radial movement of the two-piece canister.

By the use of this improved process, it has been found that long, slender rods can be isostatically molded whereas many prior art attempts to mold such rods have not been successful.

2 Claims, 7 Drawing Figures

FIG. 1
PRIOR ART
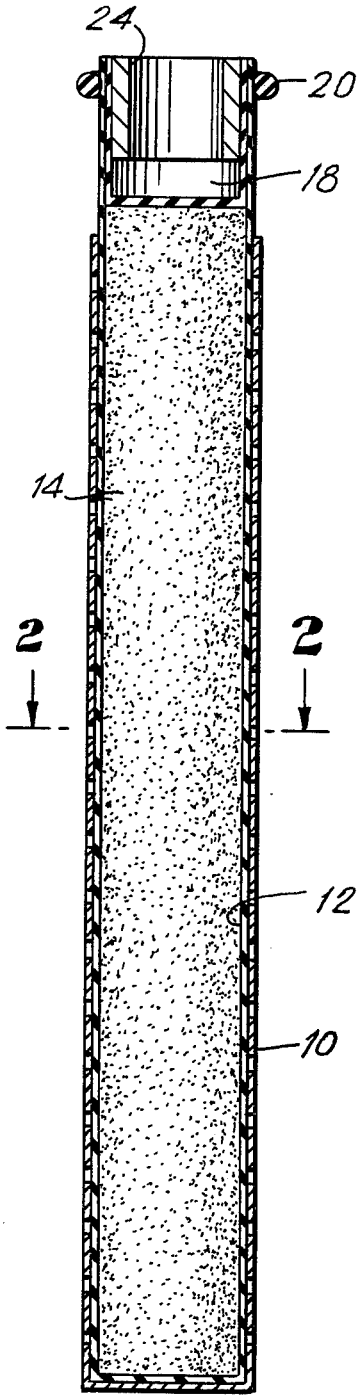
FIG. 2
PRIOR ART
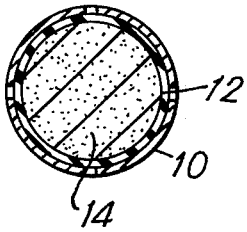
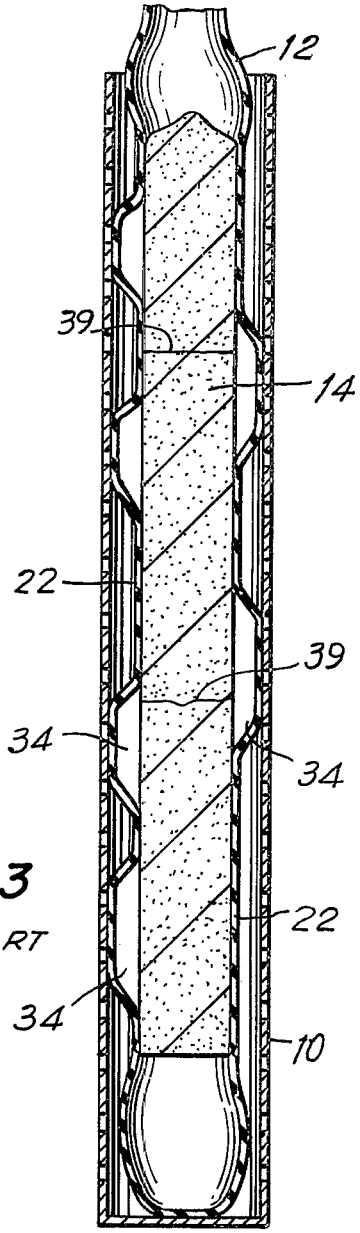
FIG. 3
PRIOR ART

METHOD FOR MOLDING PARTICULATE MATERIAL INTO RODS

BACKGROUND OF THE INVENTION

In the isostatic pressing of articles a powdered material is generally placed within a deformable mold, for example a mold constructed of polymeric material such as rubber or polyurethane. The mold is then placed within a canister, which is usually perforated, and the canister is then placed within an isostatic press and subjected to elevated pressures.

Although articles of many shapes can be formed by isostatic pressing, problems are presented when it is desired to produce long, slender rods. Exemplary of such problems are the events which lead to the making of the invention disclosed herein. Thus, attempts were made to isostaticly mold slender rods by the following procedure. Powdered tungsten material was packed in a latex mold 600 mm in length and having an internal diameter of 19 mm and a wall thickness of 1.5 mm. The rubber mold was then sealed and placed in a conventional, perforated canister. FIGS. 1 and 2 show the arrangement which resulted.

More specifically, as shown in FIGS. 1 and 2, the arrangement included a perforated steel canister 10 surrounding the latex mold 12 which contained the tungsten powder 14. In accordance with conventional practice, the mold 12 was sealed with a latex plug 18 and a rubber seal ring 20 which compressed the mold against a steel ring 24.

Canister arrangements of the type shown in FIG. 1 were isostaticly pressed at pressures of 45,000 psi or 60,000 psi. After each was removed from the press it was found that the mold was stuck within the canister. Upon close inspection of the mold and canister, it appeared that certain parts of the mold were secured to the formed rod and between the points of securement bubbles had formed and the bubbled portions of the mold were jammed against the canister. FIG. 3 suggests the arrangement of the rod, mold and canister which was generally found to exist wherein, at points 22, the mold 12 was secured to the rod 14 and therebetween bubbles 34 had formed in the mold and were jammed against the canister 10. To remove the mold from the canister, it was necessary to puncture each of the balloons with a needle.

After each of the molds was removed from its respective canister, substantial difficulty was encountered in the removal of the rod from the mold. In certain cases, it was possible to remove the rod from the mold by inserting the mold in a vacuum chamber. In most cases, however, it was found that the compacted rod was broken in two or three location, as shown at 39 in FIG. 3, before the mold was removed. Typically, out of twenty pressings only four complete rods would be obtained.

After a number of unsuccessful attempts, urethane molds were tried in place of the latex rubber molds. For these tests, both hard and soft urethane material was employed and with molds having both thin and thick walls. With each of these tests it was found that the compacted rod was broken into more than ten pieces.

Subsequently, it was attempted to mold slender rods through the use of an unperforated canister. However, again it was found that bubbles were formed and the mold could only be removed after puncturing the bubbles with a needle and, even with this procedure, a majority of the rods were found to be broken after removal from the mold.

The invention disclosed herein provides a simple solution of the problem of isostatically molding slender rods.

SUMMARY OF THE INVENTION

A canister for containing a slender isostatic mold wherein the canister is longitudinally split and, when used, is resiliently clamped, for example by the use of rubber bands.

DESCRIPTION OF THE DRAWINGS

FIG. 1 is a side view, in section, of a prior art isostatic tooling.

FIG. 2 is a view, in section, taken along the section line 2—2 of FIG. 1.

FIG. 3 is a side view, in section, of the tooling of FIG. 1 subsequent to an isostatic pressing.

DESCRIPTION OF PREFERRED EMBODIMENT

Figure 4:
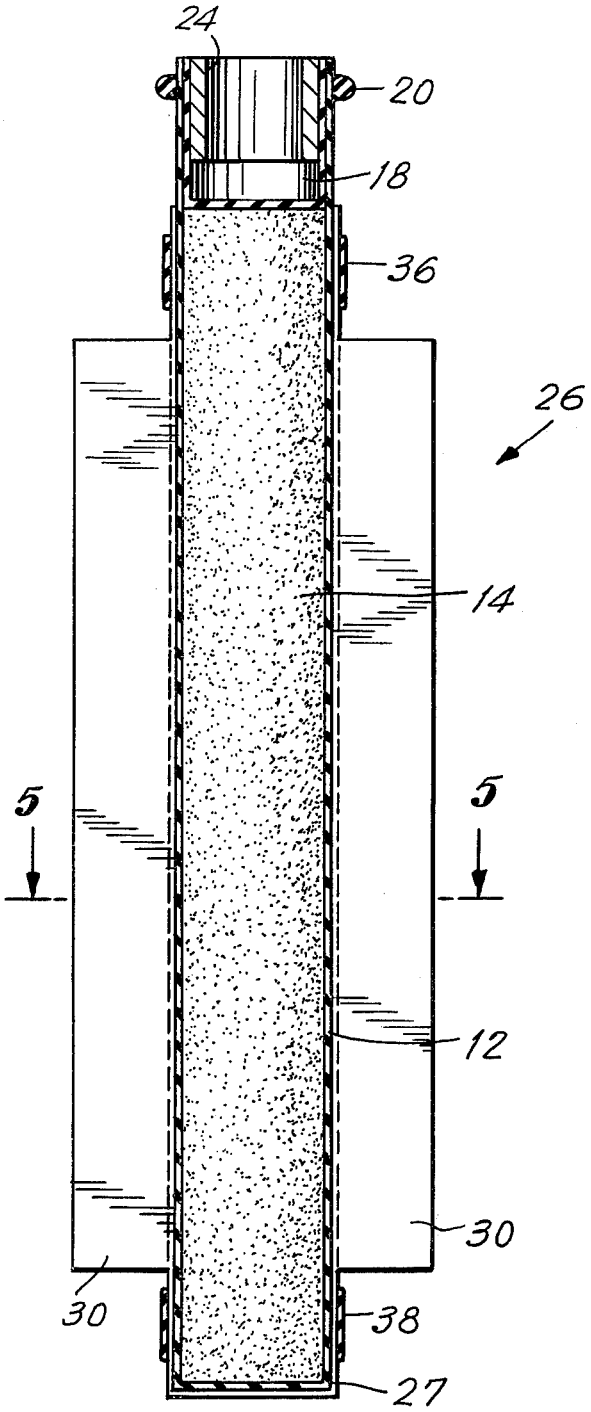
FIG. 4 is a side view, in section, of an isostatic tooling embodying this invention.

In an effort to at least facilitate removal of a slender mold from a canister after isostatic pressing, it was concluded that the canister should be longitudinally split and during the pressing operation held together by a resilient clamping means, for example rubber bands. Thus, referring to FIGS. 4 and 5, there was employed a canister 26 which was longitudinally split, as seen most clearly in FIG. 5. Each of the split portions 27, 28 was provided with radially extending fins 30, 32 to facilitate alignment when the split halves were assembled. The split portions 27, 28 were perforated in the conventional manner. When the split portions 27, 28 were assembled around the mold 12, they were resiliently clamped together by rubber bands 36, 38.

Figure 5:
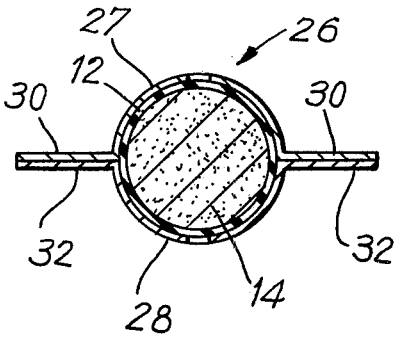
FIG. 5 is a view, in section, taken along the section line 5—5 of FIG. 4.
Figure 6:
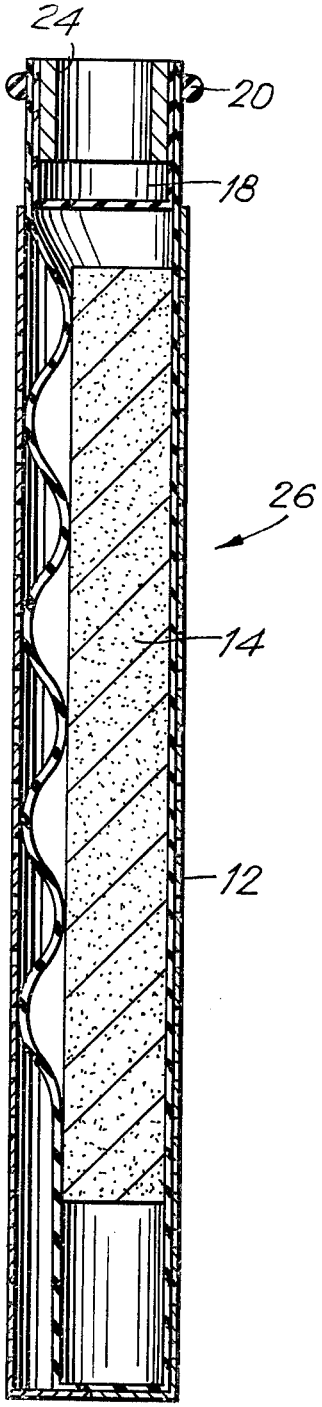
FIG. 6 is a side view, in section, of the tooling of FIG. 4 subsequent to an isostatic pressing.

A tooling arrangement of the type shown in FIG. 4 was prepared wherein powdered tungsten was packed in a latex mold 12 of the size hereinbefore described. A split canister 26 was assembled around the mold 12 and rubber bands 36, 38 were placed around opposite ends of the canister. The resilient clamping force of the rubber bands 36, 38 was such that the canister could be opened 2 to 3 mm by grasping the canister 26 in the center and manually pulling apart the split portions. The tooling was then isostatically pressed. Upon removal from the press and removal of the rubber bands, it was found that the mold was easily removed from the canister. Most surprising, however, were other effects which were observed. For example, although bubbles were once again formed, as shown in FIG. 6, it was found that all the bubbles had formed only along one side of the compact.

Figure 7:
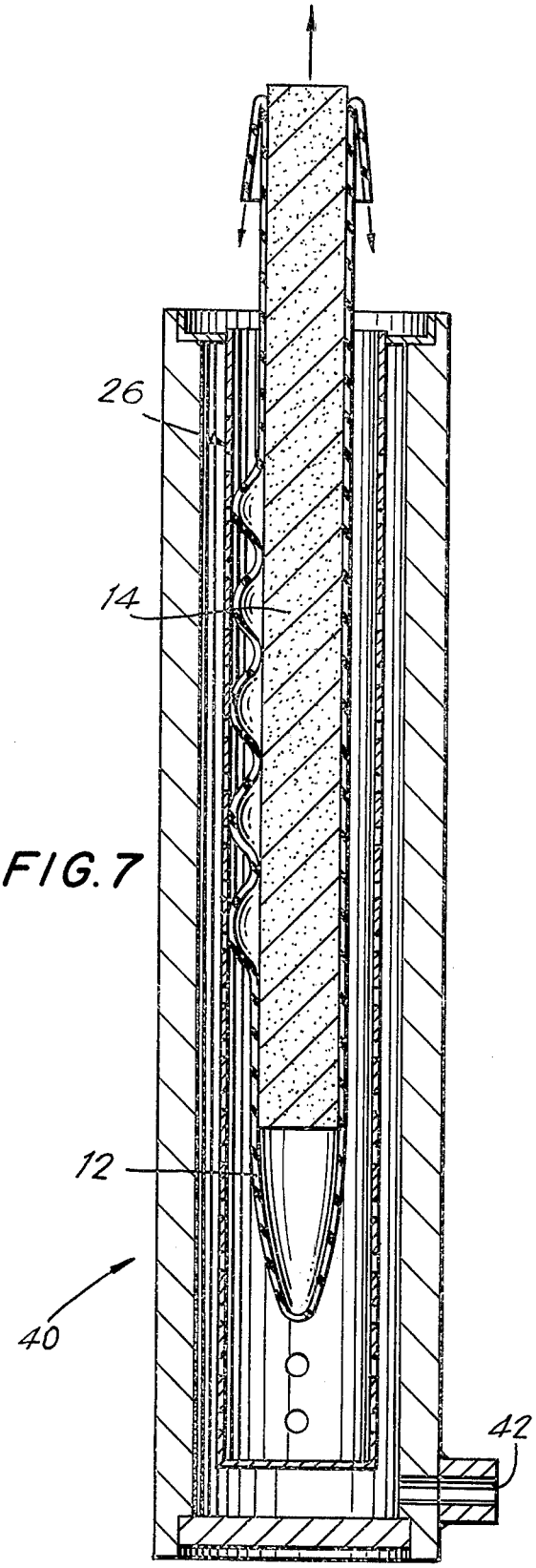
FIG. 7 is a side view, in section, of a vacuum chamber containing an isostatic tooling.

To remove the compact from the mold, there was employed a vacuum chamber 40 of the type shown in FIG. 7. To prevent overstretching of the mold 12, the split canister 26 was left in its position surrounding the mold. Upon application of a vacuum through port 42, the compacted rod 14 could be pulled from the mold in approximately 1 minute. Upon repeating this procedure a number of times, it was surprisingly found that none of the rods thus produced were cracked or broken. Thus, a method was discovered whereby long, slender rods may reliably be produced by isostatic pressing.

Although the operating mechanism of this discovery is not fully understood, it has been suggested that a method which embodies this discovery permits the isostatic molding of long slender rods by reducing or eliminating a decompressive shock which the compact would otherwise experience. More specifically, it was suggested that during the compression stage of the molding process, parts of the soft rubber molding were trapped between particles in the compact. During decompression, air pressed out of the compact expanded against the mold. Since parts of the mold were secured to the compact by being trapped between particles of the compact, bubbles were formed. In prior art, one-piece canisters, outward growth of the bubbles was restrained by the canister. This restraining action, together with the rapid pressure drop which occurs during decompression, subjected the compact to a shock in the form of rapidly applied, transverse forces. As a result, the compact failed radially.

In contrast, it is believed that when a resiliently clamped, longitudinally split canister is employed, then the bubbles which are formed may expand radially outward against only the resilient clamping forces. Also, it is believed that the presence of the resilient clamping forces prevent the imposition of transverse shock loading on the compact. As a result, radial failures of the compact are avoided. In support of this theory of the operation of this discovery, it has been noted that after compaction, the two portions of the resiliently clamped canisters are generally spaced apart, sometimes as much as 10 mm.

In summary, there has hereinabove been described a preferred embodiment of the discovery of an improved tooling for the isostatic molding of slender rods and the method by which this tooling functions to achieve the desired result.

I claim:

1. In a method of isostatically molding a bondable particulate material into an elongated cylindrical article, comprising:

a. filling an elongated elastomeric tubular mold with said particulate material, b. inserting said filled mold into an elongated tubular canister having perforated walls, c. applying isostatic compression to said mold through said perforated canister to compact and to bond said particulate within said elastomeric mold into a self-supporting elongated cylindrical article, d. relieving said applied compression, e. removing from said mold said elongated cylindrical article, the improvement comprising:

f. said tubular canister consisting of at least two longitudinally split mating portions, and g. clamping said canister portions together with elastomeric means whereby during step (d) said elastomeric mold may upon radial expansion permit radial expansion of said canister portions.

2. The method of claim 1 wherein step (g) comprises placing at least one band of elastomeric material around each end of said split canister.

* * * * *